United States Patent [19]

Barkan

[11] 4,225,763

[45] Sep. 30, 1980

[54] MEANS FOR SUPPRESSING CONTACT-SEPARATION AT THE END OF A VACUUM CIRCUIT-BREAKER CLOSING OPERATION

[75] Inventor: Philip Barkan, Stanford, Calif.

[73] Assignee: General Electric Company, Philadelphia, Pa.

[21] Appl. No.: 889,466

[22] Filed: Mar. 23, 1978

[51] Int. Cl.[3] ..... H01H 33/66

[52] U.S. Cl. ..... 200/144 B

[58] Field of Search ..... 200/144 B, 145, 148 F, 200/153 H, 288, 153 V, 153 SC; 335/194, 195

[56] References Cited

U.S. PATENT DOCUMENTS

| | | | |
|---|---|---|---|
| 3,527,910 | 9/1970 | Mitchell, Jr. et al. | 200/144 B |
| 3,582,587 | 6/1971 | Barkan | 200/144 |
| 3,594,525 | 7/1971 | Miller et al. | 200/144 B |
| 3,792,213 | 2/1974 | Kane et al. | 200/144 B |
| 4,099,039 | 7/1978 | Barkan | 200/144 B |
| 4,153,828 | 5/1979 | Barkan | 200/153 V X |

*Primary Examiner*—James R. Scott

*Attorney, Agent, or Firm*—William Freedman

[57] ABSTRACT

A vacuum-type circuit breaker comprises (a) a plurality of vacuum circuit interrupters, (b) a common operating member through which closing force is applied to the movable contact rods of all the interrupters, (c) a wipe mechanism for each interrupter, and (d) a plurality of linkages, one for each interrupter, each being connected between the common operating member and the wipe mechanism for the associated interrupter. Each linkage comprises a plurality of pin joints connected mechanically in series between said common operating member and the associated wipe mechanism. Opening spring means effectively located at the movable contact rod end of each linkage that comprises at least three of said series connected pin joints applies a bias to said latter linkage that acts upon all of the pin joints in said latter linkage to eliminate from the acted-upon pin joints such clearance as allows reversal of the associated movable contact rod immediately following contact-engagement near the end of a closing operation while closing force is still being applied to said associated linkage through said common operating member.

7 Claims, 10 Drawing Figures

MEANS FOR SUPPRESSING CONTACT-SEPARATION AT THE END OF A VACUUM CIRCUIT-BREAKER CLOSING OPERATION

BACKGROUND OF THE INVENTION

This invention relates to a vacuum-type circuit breaker comprising a plurality of vacuum circuit interrupters, motive means for developing a closing force for application to the interrupters, and closing linkages respectively connecting the interrupters with the motive means. More particularly, the invention relates to means for substantially reducing the tendency of the movable contacts of the vacuum circuit interrupters to reverse their motion, or bounce away from their respective mating contacts, immediately following contact-engagement near the end of a closing operation while closing force is still being applied to the closing linkages by the motive means.

In my Application Ser. No. 752,956, filed Dec. 20, 1976, now Patent No. 4,099,039 which is incorporated by reference in the present application, I have disclosed how elasticity effects in the closing linkages can produce contact separations of several milliseconds duration shortly after the contacts engage near the end of a closing operation. In the aforesaid application, the solution to that problem involves modifying the effective initial gradient of the pre-loaded wipe springs in the usual wipe mechanisms of the circuit breaker, which mechanisms are used to couple the linkages to their respective interrupters. This approach has been found quite effective in suppressing such contact-separation when the closing linkages are essentially unworm and still have near-minimum clearances in their usual pin joints. But when these clearances increase, due to normal wear during the life of the circuit breaker, and particularly where there are a relatively large number of such pin joints interposed mechanically in series in the linkage between a common operating member and the movable contact rod of an interrupter, some such contact-separation may still occur, albeit of reduced severity and frequency of occurrence.

Vacuum interrupters are particularly susceptible to this contact-separation phenomena because massive butt contacts must be used without recourse to sliding between the mating contacts. As a consequence, only a slight reversal of contact-motion can result in a contact-separation of as much as several milliseconds duration. Such contact-separation is particularly undesirable because it produces severe contact-erosion which limits contact life and also because it increases contact-welding.

My studies have shown that the above-noted contact-separation problem that develops as the closing linkage wears is related to two conditions, the significance of which had not previously been fully appreciated:

(a) the presence in the linkage of a large number of pin joints, mechanically in series, between the common closing operating member and the movable contact rods of certain of the interrupters, and (b) the natural closing bias force on the movable contact rods of such interrupters which results from the pressure differential across the usual bellows of each such interrupter.

When the contacts of the interrupter are open, the above condition (b) results in the clearances in the pin joints being located on the common-operating-member side of the pin joints. But near the end of the closing operation, when the contacts first touch and wipe-spring force is developed on each contact rod, the loading on the contact rod reverses, causing the pins of the pin joints to shift in their bearings to the opposite side of the bearings. Due to the inherent elasticity of the linkage and to the cumulative effect of the clearances of the several pin joints, it is not possible to transmit a significant closing force to the movable contact rod instantaneously following initial contact-engagement. It is first necessary for the closing force at the driving end of the linkage to shift the pin-to-bearing clearances and then to strain the linkage sufficiently to transmit the required force.

In a conventional linkage, as the bearings wear, the cumulative value of the clearances in the series-connected pin joints becomes quite large; and, as a result, a relatively long time has been required to generate the required force to hold the contacts engaged following initial engagement. During this time the contacts can be temporarily forced out of engagement under the severe loading produced by the wipe springs immediately following initial contact-engagement.

SUMMARY

Accordingly, an object of my invention is to suppress the tendency of the contacts of a vacuum interrupter to temporarily separate following initial engagement due to the above-described cumulative clearance effect in the linkage that is being relied upon to transmit closing force to the movable contact rod.

Another object is to accomplish the preceding object through use of opening spring means occupying a near-minimum of space.

In carrying out my invention in one form, I provide: (a) a common operating member through which closing force is applied to the movable contact rods of all of the interrupters and (b) a plurality of linkages, one for each interrupter, connected between said common operating member and the usual wipe mechanism of its associated interrupter. Each of these linkages comprises a pluarlity of pin joints connected mechanically in series between said common operating member and the wipe mechanism of its assoicated interrupter. One of said pin joints for each linkage is located at the contact-rod end of the associated linkage for coupling this end of the linkage to the associated wipe mechanism, and this pin joint is devoid of any lost motion usuable to effect significant changes in stroke length of the associated interrupter. Contact-separation resulting from the above-described cumulative clearance effect is suppressed by providing opening spring means effectively located at the contact-rod end of each of said linkages that comprises at least three of said series-connected pin joints. This opening spring means applies a bias to its associated three-or-more pin joint linkage that acts upon all the pin joints in said associated linkage to eliminate from said acted-upon pin joints such clearance as allows reversal of the associated movable contact rod immediately following contact-engagement near the end of a closing operation while closing force is still being applied through said common operating member. If there is more than one common operating member for all the interrupters, then the common operating member being referred to in this paragraph is the one closest in the drive train to the interrupters.

BRIEF DESCRIPTION OF DRAWINGS

For a better understanding of the invention, reference may be had to the accompanying drawings, in which.

THE VACUUM INTERRUPTERS

Figure 1:
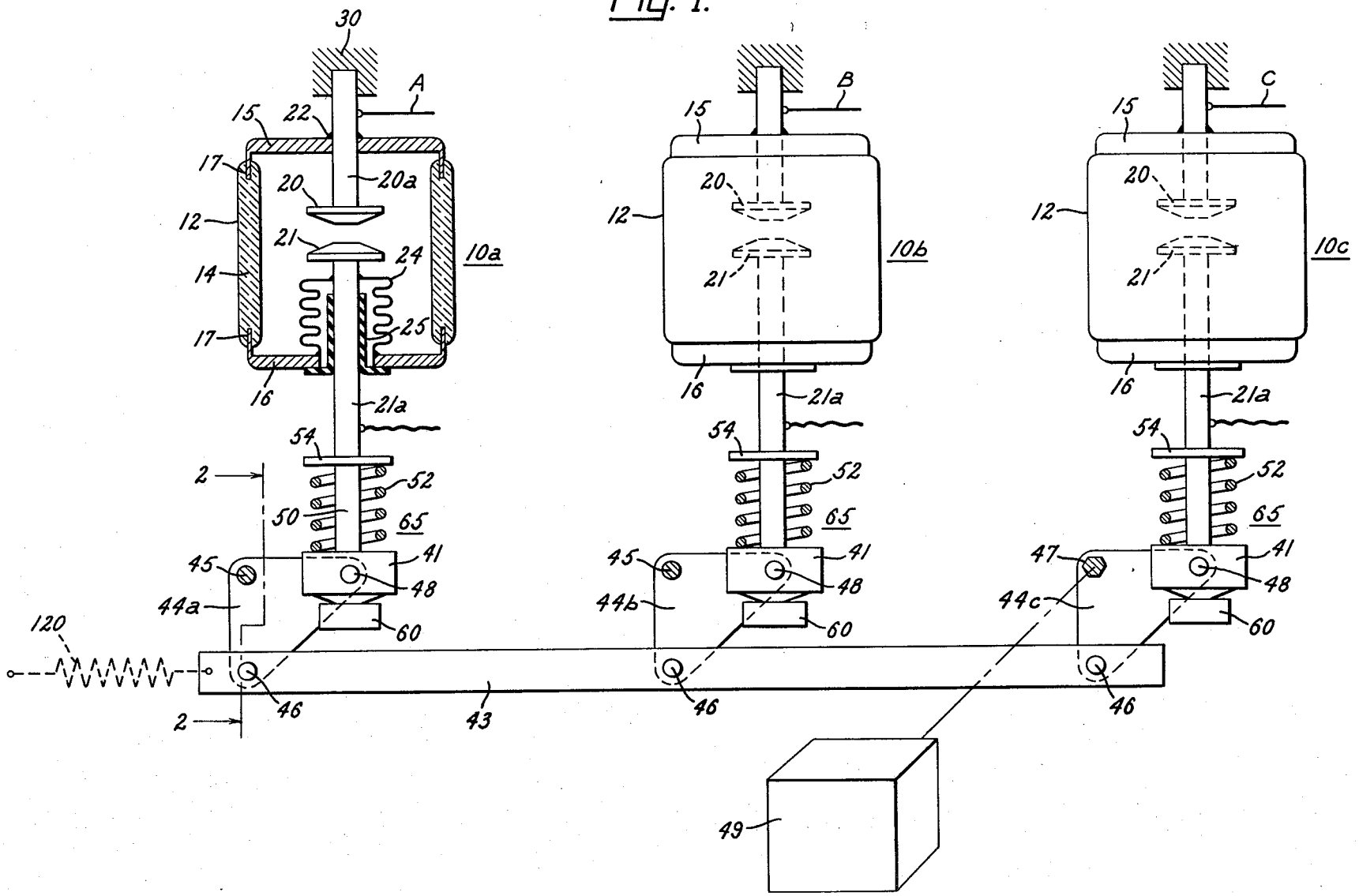
FIG. 1 is a schematic showing of a portion of a polyphase circuit breaker embodying one form of my invention. For simplification, the actual opening spring means employed has been omitted from FIG. 1.

Referring now to FIG. 1, there are shown three identical vacuum-type circuit interrupters 10*a*, 10*b*, and 10*c* respectively connected in the phases A, B, and C of a three-phase electric power circuit. Each interrupter comprises a highly-evacuated housing 12 comprising a tubular casing 14 of insulating material and two end caps 15 and 16 at opposite ends of the casing joined to the casing by suitable glass-to-metal seals 17. Located within the evacuated housing 12 are two engageable, relatively-movable contacts 20 and 21. Contact 20 is a stationary contact fixed to the inner end of a conductive stationary contact rod 20*a*, and contact 21 is a movable contact fixed to the inner end of a conductive movable contact rod 21*a*.

The two contact rods 20*a* and 21*a* extend between the interior and exterior of the evacuated housing 12 through openings in the end caps 15 and 16, respectively. A vacuum-tight welded joint 22 secures stationary contact rod 20*a* to end cap 15. A flexible metal bellows 24 of conventional form surrounds movable contact rod 21*a* and provides a flexible vacuum-tight joint therearound that allows contact rod 21*a* to be moved vertically without impairing the vacuum inside envelope 12. A tubular guide 25 suitably fixed to the lower end cap guides the movable contact rod 21*a* along a substantially straight-line vertical path.

Each interrputer is supported at its stationary-contact end by means of a stationary support schematically shown at 30 in FIG. 1.

THE CLOSING LINKAGES

Figure 2:
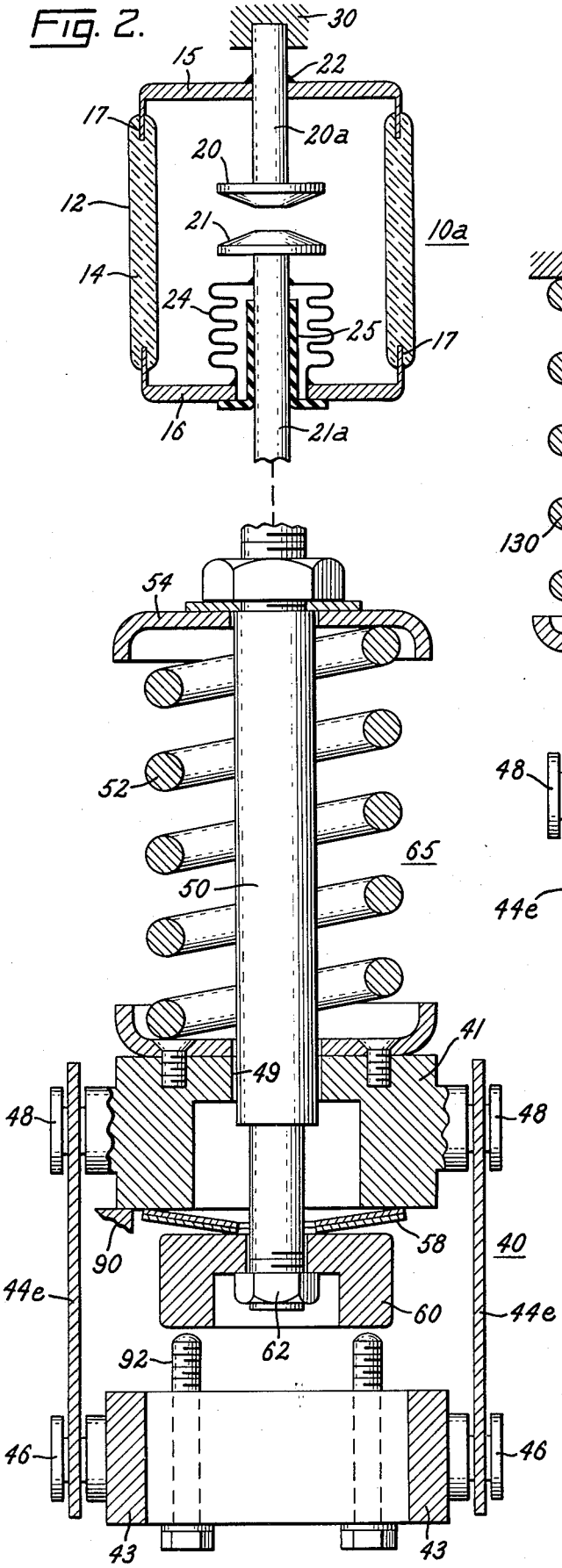
FIG. 2 is a sectional view along the line 2—2 of FIG. 1 showing one of the interrupters of FIG. 1 and a portion of its associated closing linkage.

For actuating the movable contact rod 21*a* of each interrupter, each interrupter is provided with a force-transmitting member in the form of a trunnion 41 that is upwardly movable in a vertical direction from its position of FIG. 1 to close the interrupter. As shown in FIGS. 1 and 2, trunnion 41 associated with interrupter 10*a* is coupled to a horizontally-movable link 43 through a bell crank 44*a* that comprises two identical, interconnected bell crank segments 44*e* that are pivoted on a stationary pivot 45. The bell cranks associated with the interrupters 10*b* and 10*c* are designated 44*b* and 44*c*, respectively. One arm of each bell crank 44 is pivotally connected to horizontally-movable link 43 by a pivot pin 46, and the other arm is pivotally connected to trunnion 41 by a pivot pin 48. Link 43 is adapted to be driven in a horizontal closing direction, i.e., to the right in FIG. 1, to effect closing of interrupters 10*a* and 10*b*.

Rightward closing motion of the link 43 is effected by rotating the bell crank 44*c* of the interrupter 10*c* in a counterclockwise direction from its position of FIG. 1. Such counterclockwise rotation is effected by closing force transmitted through a common operating member for the three interrupters in the form of a rotatable torsion drive shaft 47 that is splined to the bell crank 44*c*. Rotation of the torsion drive shaft 47 to close the interrupters can be effected by any suitable closing device, but I prefer to use the closing device shown and claimed in my application Ser. No. 703,328, now Pat. No. 4,153,828 filed on July 8, 1976, and assigned to the assignee of the present invention. Said closing device is mechanically connected through a suitable closing mechanism (not shown in the present application) to the torsion drive shaft 47 of the present application. The closing device plus the closing mechanism is occasionally referred to herein as motive means for developing a circuit-breaker closing force. Such motive means is schematically shown in FIG. 1 as the block 49.

The pin joints at 45, 46, and 48 in the above-described closing linkages are of a conventional design. Each comprises a pin received in a surrounding cylindrical bearing, with a clearance of less than 25 mils between the pin and bearing when the linkage is new. A typical clearance is about 2 to 3 mils when the linkage is new. When the linkage is actuated during a closing operation, relative rotation occurs between the pin and its surrounding bearing, and this produces wear which gradually increases the clearance present. It is to be noted that the pin joint at 48 has no lost motion in it that is usable for effecting significant changes in stroke length of the associated interrupter and, thus, is altogether different from the lost-motion type joint at 40, 41, 42 in my U.S. Pat. No. 3,582,587.

WIPE MECHANISM 65

Referring to FIG. 2, trunnion 41 has a central hole 49 that slidably receives an operating rod 50 that is positively coupled to movable contact rod 21*a* of the interrupter 10*a*. For transmitting closing force from trunnion 41 to operating rod 50, a compression-type wipe spring 52 is provided. This wipe spring bears at its lower end against trunnion 41 and at its upper end against a shoulder 54 effectively fixed to operating rod 50. Compression spring 52 is preloaded so that it exerts a predetermined upward force on the upper end of operating rod 50 when the parts are in the position of FIG. 2.

Opposing the upwardly-acting force of wipe spring 52 on operating rod 50 is a disc spring 58 which exerts a downward force on the operating rod 50. This disc spring comprises one or more annular washers normally of a generally conical shape located between the lower face of trunnion 41 and a stop 60 on the lower end of operating rod 50. Stop 60 is free to slide on the operating rod but is normally held by spring force against a nut 62 fixed to the lower end of the operating rod, as shown in FIG. 2. The wipe spring 52 is substantially stronger than the disc spring 58 and thus deflects the normally-conical disc spring into the almost flat configuration of FIG. 2 when the parts are in their position of FIG. 2. The following parts may be thought of as constituting a wipe mechanism 65 for coupling the aforesaid bell crank 44*a* to the upper end of operating rod 50: trunnion 41, wipe spring 52, disc spring 58, parts 54, 50, and 62, and the lower end of operating rod 50. A corresponding wipe mechanism 65 is present for each of the other interrupters.

Figure 3:
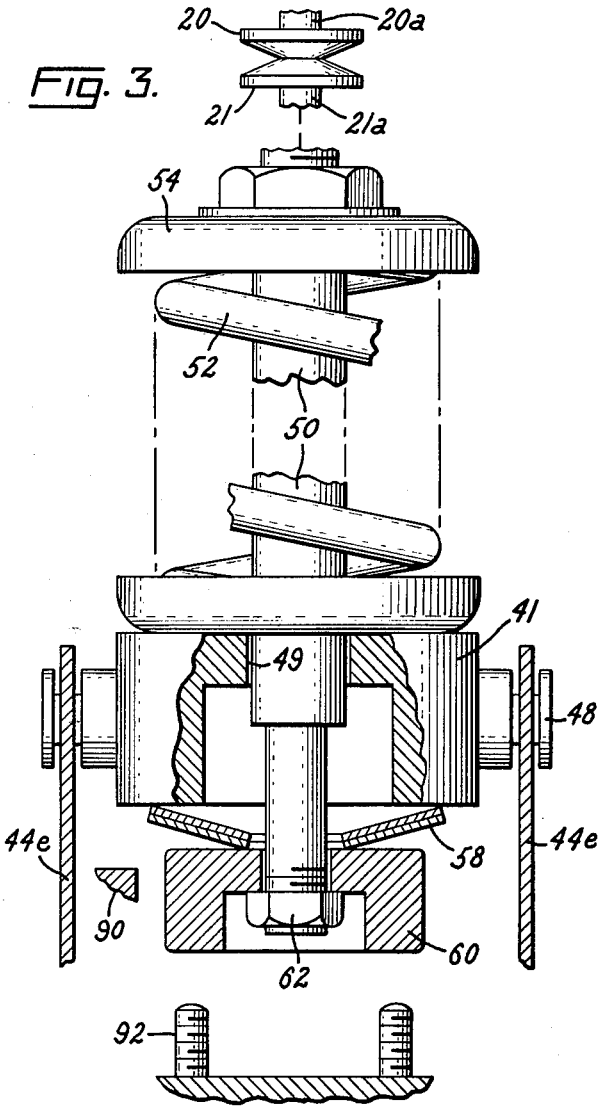
FIG. 3 illustrates the assembly of FIG. 2 immediately after the contacts of the interrupter have engaged near the end of a closing operation.

When trunnion 41 is driven upwardly during a closing operation, it transmits closing force through the wipe spring 52 to operating rod 50 without substantially deflecting the springs 52 and 58 until movable contact 21 engages stationary contact 20. The trunnion 41 continues to move upwardly following initial contact-engagement, and this compresses the wipe spring 52 while allowing the disc spring 58 to unload and return toward its normal generally-conical shape. This continued upward movement of the trunnion 41 is referred to as wipe travel. FIG. 3 depicts the parts at an intermediate point in the course of such wipe travel.

Figure 4:
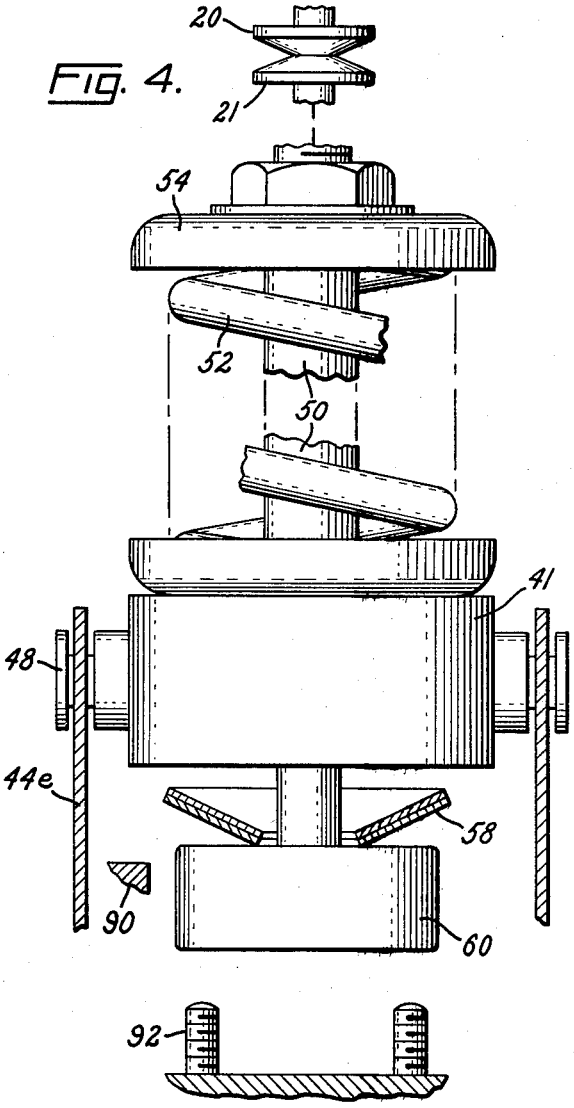
FIG. 4 illustrates the assembly of FIG. 2 after the closing operation has been completed.

FIG. 4 depicts the parts after such wipe travel has been completed. It will be apparent from FIG. 4 that the additional wipe travel of the trunnion 41 past the position of FIG. 3 further compresses wipe spring 52 and completely unloads disc spring 58, opening a gap between the lower side of the trunnion 41 and the unloaded disc spring 58. Each of the interrupters reaches a fully-closed position corresponding to that of FIG. 4 substantially simultaneously, at which time the circuit breaker is considered fully-closed. The circuit breaker is held in this fully-closed position by a suitable trip latch (not shown, but located in the closing mechanism that is coupled to the operating shaft 74).

Opening the Circuit Breaker

Opening of the circuit breaker is effected by releasing the above-mentioned trip latch and allowing opening spring means (described hereinafter) to discharge and return the circuit breaker to its position of FIG. 1. Each trunnion 41 and its associated operating rod 50 move downwardly during such opening motion, and such downward motion is terminated at the end of the opening stroke by stationary stops 90 and 92 in the manner described in my aforesaid application Ser. No. 752,956 now U.S. Pat. No. 4,099,039.

Figure 7:
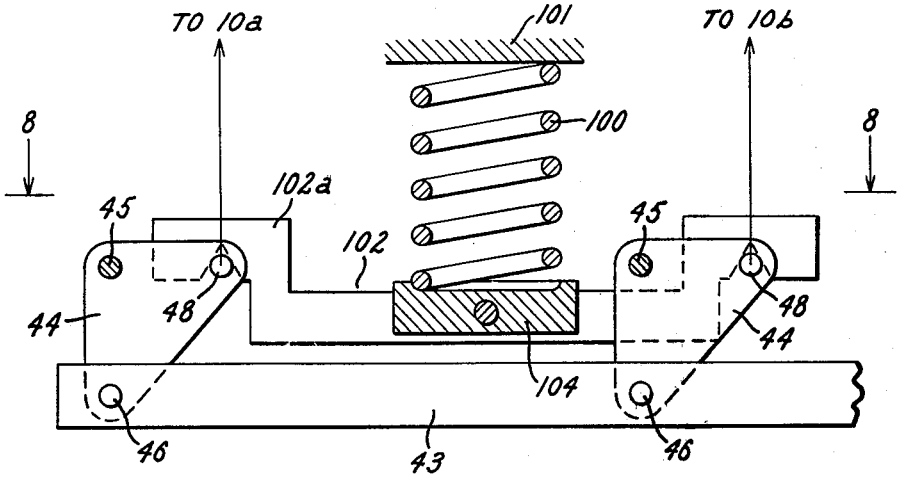
FIG. 7 is a side elevational view, partly schematic, of the opening spring means used for the circuit breaker of FIG. 1.
Figure 8:
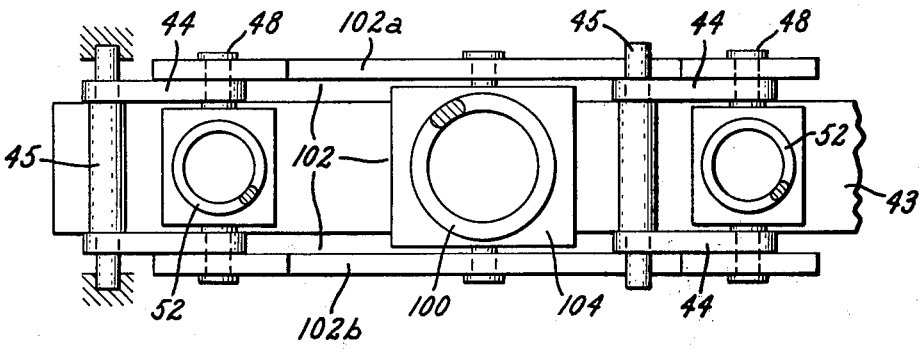
FIG. 8 is a sectional view along the line 8—8 of FIG. 7.

FIGS. 7 and 8 illustrate a preferred form and location of the opening spring means. In FIGS. 7 and 8 the opening spring means comprises a spring 100 having its upper end bearing against a stationary frame 101 and its lower end bearing against a floating beam 102. The floating beam 102 comprises two laterally-spaced identical segments 102*a* and 102*b* and a trunnion member 104 connecting these segments together. The lower end of spring 100 is seated on the trunnion member 104. Each end of the two segments 102*a* and 102*b* have a notch acting as a load bearing surface receiving one of the pivot pins 48. Thus, the opening spring 100 acts through the floating beam 102 to apply a downward opening force to the pivot pins 48 of the two closing linkages respectively associated with the two interrupters 10*a* and 10*b*.

The location of the opening spring 100 at the contact-rod end of the closing linkages connected to movable contact rods of interrupters 10*a* and 10*b* is an important feature of my invention, as will soon appear more clearly.

In most prior circuit breakers of the general type illustrated, the opening spring has been attached to a common connecting element such as the link 43 of FIG. 1. To facilitate the following discussion, an opening spring so located is shown in dotted lines at 120 in FIG. 1. In my initial work on this circuit breaker, this is actually where I located my opening spring. But with the opening spring so located, I encountered the contact-separation problem which will now be discussed. In the immediately-following section discussing the problem, it will be assumed that the opening spring is connected as shown in dotted lines at 120.

Contact Separation Problem with Opening Spring Assumed To Be Located as Shown at 120 in FIG. 1

In my aforesaid application Ser. No. 752,956 now U.S. Pat. No. 4,099,039, I have disclosed how elasticity effects in the linkage comprising link 43 and bell cranks 44*a*, 44*b*, and 44*c* can produce contact separations of several milliseconds duration shortly after the contacts engage near the end of a closing operation. In the aforesaid application, that problem was solved by modifying the effective initial gradient of the pre-loaded wipe springs 52 by incorporating the above-described disc springs 58 in the wipe mechanisms 65. As pointed out in the background statement of the present application, this approach has been effective in suppressing such contact-separation in an unworn closing linkage, i.e., a closing linkage in which minimum clearances are present in the pin joints at 46, 45, and 48. But I have found that when these clearances increase, as a result of normal wear during the life of the circuit breaker, some such contact-separation may still occur if the opening spring is located as shown at 120 in FIG. 1. I have found that this is particularly so where there are a relatively large number of such pin joints interposed mechanically in series in the linkage between a common operating member, such as torsion drive shaft 47 in FIG. 1, and the wipe mechanism 65 of an interrupter.

With respect to the number of series-connected pin joints in the various linkages, refer to FIG. 1 and note that only a single pin joint (at 48 on bell crank 44*c*) is interposed in the linkage that interconnects torsion drive shaft 47 and the wipe mechanism 65 of the interrupter 10*c*. But in the linkage that interconnects torsion drive shaft 47 and the wipe mechanism of the interrupter *10b*, there are a total of four pin joints mechanically in series, i.e., the one pin joint at 46 on crank 44*c* and the three pin joints at 46, 45, and 48 on crank 44*b*. And in the linkage that connects drive shaft 47 to the wipe mechanism 65 of interrupter 10*a*, there are also four pin joints mechanically in series, i.e., the one pin joint 46 on crank 44*c* and the three pin joints at 46, 45, and 48 on crank 44*a*.

My studies with this circuit breaker, assuming the opening spring is located as illustrated at 120, have shown that as the pin joints at 46, 45, and 48 wear during extended life tests, there is a substantially greater tendency for the above-described contact-separation at the end of the closing stroke to occur with the interrupters 10*a* and 10*b* than with the interrupter 10*c*. My studies indicate that this greater tendency of the contacts to separate is dependent to a significant extent upon the larger number of pin joints present in the linkages associated with interrupters 10*a* and 10*b* than in the linkage associated with interrupter 10*c*. As the pin joints wear, the cumulative resulting clearance in a linkage is directly dependent upon the number of pin joints present. Hence, a much greater cumulative clearance develops in the linkages associated with interrupters 10*a* and 10*b* than in the linkage associated with interrupter 10*c*.

Figure 5:
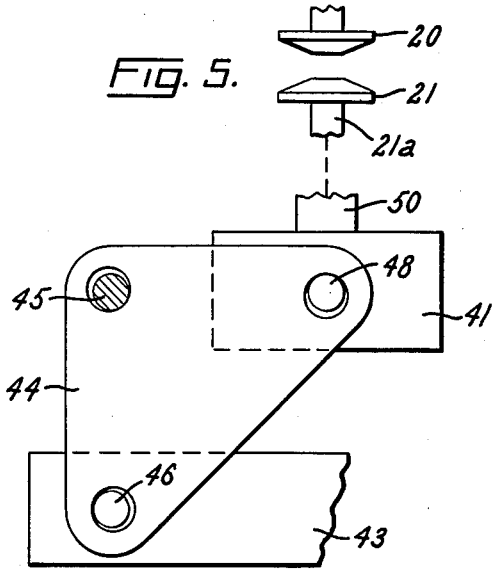
FIG. 5 is a schematic showing of a portion of one of the closing linkages showing the pin joint clearances in exaggerated form when the circuit breaker is open.
Figure 6:
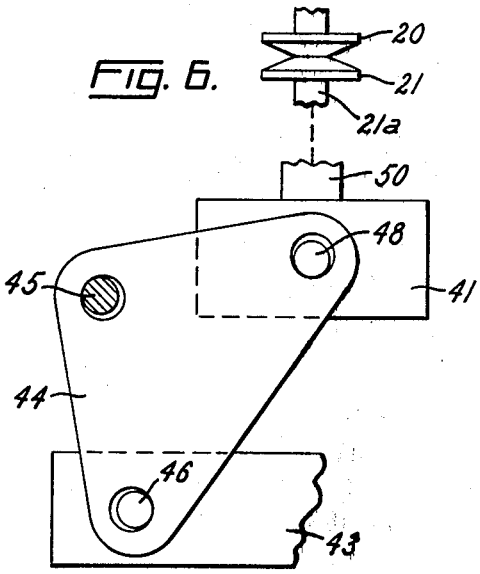
FIG. 6 is a schematic showing of the parts of FIG. 5 after the interrupter contacts have first engaged near the end of a closing operation.

The above-described contact-separation problem, I have found, is also related to another condition; and that is: the natural closing bias force on the movable contact rods, which force results from the pressure differential across the bellows of each vacuum interrupter. Assuming the opening spring is located as shown at 120 in FIG. 1, when the contacts of the interrupter are open, this bellows force results in the clearances in most of the pin joints being shifted toward the common-operating-member side of the pin joints, as schematically shown in exaggerated form in FIG. 5. During the closing operation until the contacts reach engagement, the bellows force drives the movable contact rod ahead of its associated closing linkage, maintaining the clearances in the pin joints on the same side of the pins as shown in FIG. 5. But when the contacts reach engagement and the wipe-spring force begins to build-up, the wipe spring force overwhelms the bellows force, thus causing the pins to shift to opposite sides of their bearings from their location of FIG. 5. FIG. 6 illustrates the parts after the pins have shifted in this manner immediately following contact-engagement.

In order to maintain and increase the contact force immediately following initial contact-engagement, closing force must be transmitted to the movable contact rod from the relatively massive closing linkage comprising the parts 43 and 44. However, due both to the inherent elasticity of this linkage and to the cumulative effect of the clearances of the several pin joints in the linkage, it is not possible to transmit a significant closing force to the movable contact rod simultaneously following initial contact-engagement. It is first necessary for the closing force to shift the pin-to-bearing clearances from their position of FIG. 5 to that of FIG. 6 and then to strain the linkage sufficiently to transmit the required force.

If n pin joints, each with a clearance of e inches, are present in the load path, and if the linkage stiffness is K, and it is desired to transmit a force $F_i$, then the distance X which the linkage must move after the contacts initially engage is:

$$X = n \cdot e + F_i/K$$

If the linkage is moving with an effective velocity v, then the time t needed to generate this force is on the order of:

$$t = \frac{X}{v} = \frac{n \cdot e + \frac{F_i}{K}}{v}$$

With a relatively large number of worn pin joint bearings, the term n·e becomes quite large so that the time needed to generate the required force is too long. Thus, the contacts are forced out of engagement under the severe loading produced by the wipe springs. Milliseconds later the contacts are returned to their closed position when the closing linkage has moved sufficiently far to take up the clearances sufficiently and to strain the linkage sufficiently.

A Solution to the Problem of Contact Separation Due to Clearance Effects

I have found that I can prevent contact separations at the end of the closing stroke due to the above-described clearance effects in the closing linkage if I locate the opening spring means as shown in FIG. 7 instead of as shown at 120 in FIG. 1. In FIG. 7 the opening spring means is located at the contact-rod end of the closing linkages respectively associated with the interrupters 10*a* and 10*b*. When the opening spring means is so located (i.e., as shown in FIG. 7), its loading is imposed on all the pin joints in the load paths, or linkages, between the common operating shaft 47 and the wipe mechanisms 65 of the interrupters 10*a* and 10*b*. As previously pointed out, there are four pin joints in each of these linkages. As a result of this loading, the pin clearances are continuously maintained in the correct direction to enable the pin joints, upon initial contact-engagement, to accept the transmission of closing force without any significant time delay. Accordingly, the movable contacts of interrupters 10*a* and 10*b* do not have an opportunity upon initial contact-engagement to separate from their mating stationary contacts prior to the build-up of an effective closing force thereon.

It is to be noted that in the embodiment of FIGS. 1 and 7 there is no opening spring means located at the contact-rod end of the closing linkage of interrupter 10*c*. My tests have shown that an opening spring means in the location is not required to prevent contact separations of interrupter 10*c*. Since there is only one pin joint (at 48) in the linkage associated with this interrupter (10*c*), i.e., in the power path between torsion drive shaft 47 and the wipe mechanism 65 of interrupter 10*c*, the clearance present is so small that effective closing force can be built up on the associated movable contact rod 21*a* before contact-separation in the interrupter 10*c* can occur.

By omitting any opening spring means at the contact-rod end of the closing linkage for interrupter 10*c* by using a single opening spring means, as shown in FIG. 7, at the contact-rod ends of the respective closing linkages for the other two interrupters 10*a* and 10*b*, I am able to use a single opening spring means for the three interrupters. Being able to use a single opening spring means rather than three separate opening spring means substantially reduces the amount of space required to accommodate the complete opening spring means.

It is to be noted that while I have omitted opening spring means from the contact-rod end of one of the closing linkages, i.e., the closing linkage associated with interrupter 10*c*, I nevertheless have provided opening spring means at the contact-rod ends of all those closing linkages that have three or more pin joints between the common operating member 47 and the associated wipe mechanism 65. Omission of opening spring means from any one of these three-or-more pin joint linkages at the contact-rod end of the linkage would present a significant chance that the associated interrupter would be subject to the contact-separations that I seek to prevent.

As pointed out hereinabove, the closing linkage for interrupter 10c includes a single pin joint (48) between the common operating member 47 and the wipe mechanism 65 of interrupter 10c. In counting the pin joints in a given closing linkage, I count from the common operating member in the drive train for all the interrupters that is closest to the interrupters, which, in the embodiment of FIG. 1, is the member comprising the torsion drive shaft 47 and the bell crank 44c that is rigidly fixed, or splined, thereto.

Modified Embodiment

If there is sufficient space in the circuit breaker to accommodate three opening spring devices, then I can practice my invention in a modified form by providing opening spring means for each of the interrupters at the contact-rod of each interrupter.

Figure 9:
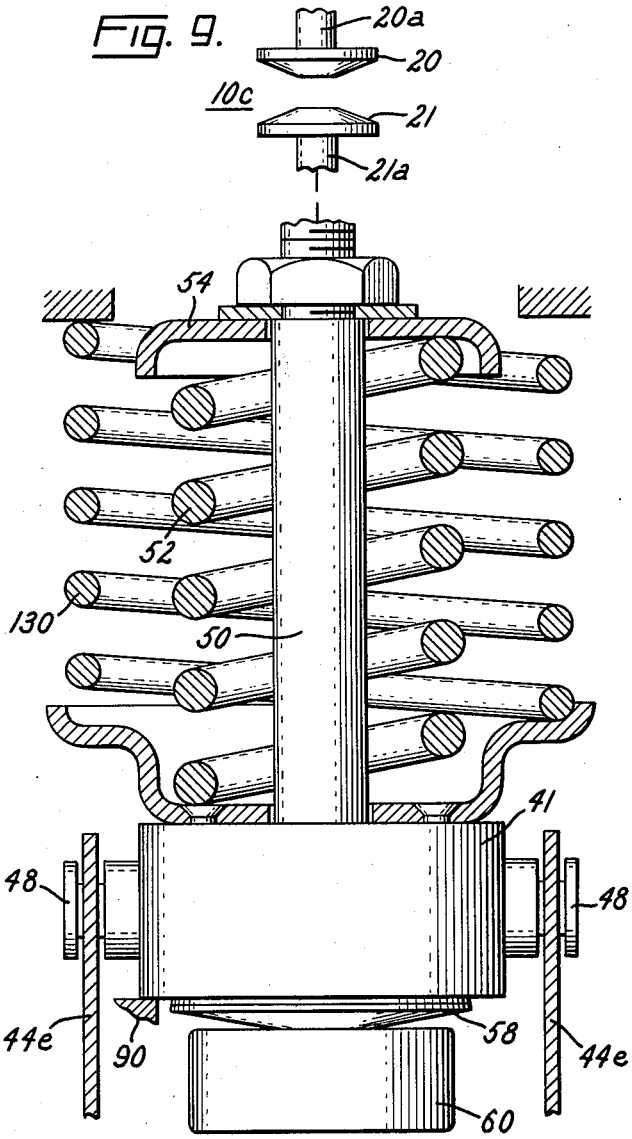
FIG. 9 is a view similar to FIG. 2 but showing a modified form of the invention.

FIG. 9 is a view similar to that of FIG. 1 illustrating one such opening spring device at 130 applied to one of the interrupters. An identical opening spring device 130 is provided for each interrupter in a corresponding location in this modified form of the invention. I can rely upon these three opening spring devices 130 to suppress contact-separations due to linkage clearance effects, assuming the opening spring devices are more sufficiently strong to maintain the clearances in the associated pin joints on the correct side of the pins therein

Additional Modified Embodiments

Figure 10:
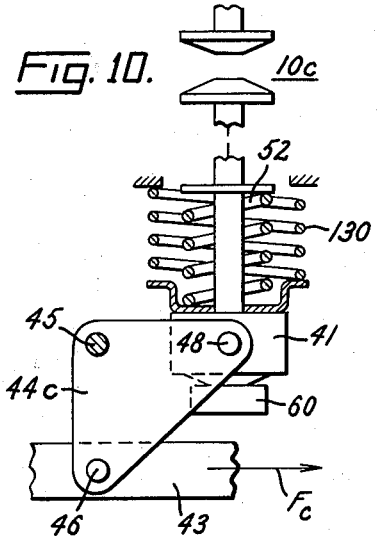
FIG. 10 is a schematic showing of another modified form of the invention.

Although FIG. 1 shows the bell crank 44c that is associated with the interrupter 10c being driven by a torsion drive shaft 47, my invention in its broader aspects comprehends using a passive point 45 at this location and applying closing force $F_c$ directly to the horizontal link 43 at its right hand end, as shown in FIG. 10. If this approach is used, an additional opening spring device, such as 130 in FIG. 9, should be applied at the contact-rod end of the associated linkage for interrupter 10c to eliminate clearance effects in this linkage. This is in addition to the presence of similar springs 130 being provided for the other interrupters 10a and 10b in corresponding locations.

Although I have illustrated my invention applied to a circuit breaker in which the plural interrupters are the interrupters of the respective phases of a polyphase circuit breaker, it is to be understood that the invention is also applicable to circuit breakers in which the plural interrupters are electrically related in other ways, e.g., connected in series, as in a multi-break high voltage circuit breaker. The arrangement of FIG. 10 can be readily adapted to such use by making the link 43 of insulating material and extending it to a ground potential location where it can be readily operated by an operating device (not shown) at ground potential.

As pointed out hereinabove, the illustrated circuit breaker uses two special features to prevent contact separations at the end of the closing stroke: (i) modification of the spring gradient of the wipe springs and (ii) location of the opening spring means effectively at the contact-rod end of certain of the closing linkages. While certain circuit breakers need both these features to essentially completely eliminate these contact-separations, it is to be understood that each of these features can significantly contribute without the other to the desired suppression of contact-separations. In certain cases, the presence of either one of these two features may be sufficient. Thus, my present invention in its broader aspects comprehends the use of feature (ii) without feature (i).

Since feature (i) is described in detail in my aforesaid Application Ser. No. 752,956 now U.S. Pat. No. 4,099,039, and since such application is incorporated by reference in the present application, all the details of feature (i) have not been included herein. But the following additional details may be noted with respect to feature (i). The bounce-suppressing disc spring 58 in each of the wipe mechanisms 65 acts in opposition to the wipe spring 52, discharging to aid continuing motion of the force-transmitting trunnion member 41 in a closing direction during the initial stages of said continuing motion after initial contact-engagement at the end of the closing stroke. Disc spring 58 has a stiffness gradient sufficiently low to effectively present separation of the associated contacts immediately following said initial engagement at the end of a closing stroke. In the illustrated embodiment, each three-or-more pin joint linkage associated with a given wipe mechanism 65 has a stiffness gradient that would permit contact-separation immediately following said initial contact-engagement if said bounce-suppressing spring was absent from its associated wipe mechanism.

General Discussion

In analyzing the above-discussed circuit-breaker operating mechanism, I have found that if the closing device (49) imposes a sufficient positive acceleration on the drive shaft 47 during the closing operation, I can prevent the clearances associated with the pivot pins 46, 45, and 48 from shifting into positions such as shown in FIG. 5 during the closing operation, even if the opening spring is located in the position of spring 120 of FIG. 1. But in the particular operating mechanism that I rely upon here, it is not practical to construct the operating mechanism to provide such positive acceleration. Accordingly, it is necessary in my circuit breaker to rely upon opening spring means located, as described hereinabove, at the contact-rod end of certain of the linkages to maintain the pin joint clearances in positions such as depicted in FIG. 6 during the closing operation.

Up to this point in the present description, I have not mentioned pin joint clearances which might be present in the closing mechanism located within block 49 of FIG. 1. These clearances are not significant with respect to the contact-separation phenomena that I am here concerned with because the opening spring means (e.g., 100–104) located further downstream in the power path imposes a bias that effectively eliminates the effect of such clearances in the mechanism (in the same way as this bias acts on the linkage to eliminate such clearance effects).

While I have shown and described particular embodiments of my invention, it will be obvious to those skilled in the art that various changes and modifications may be made without departing from the invention in its broader aspects; and I, therefore, intend herein to cover all such changes and modifications as fall within the true spirit and scope of my invention.

What I claim as new and desire to secure by Letters Patent of the United States is:

1. A vacuum-type circuit breaker comprising:

(a) a plurality of vacuum circuit interrupters, each comprising:

(i) an evacuated envelope, (ii) a pair of separable contacts within said envelope, (iii) a movable contact rod secured to one of said contacts for actuating said one contact and extending between the inside and outside of said envelope, and (iv) a bellows providing a seal between said movable contact rod and said envelope on which pressure external to said envelope acts to apply a bellows force to said contact rod in a direction to drive said one contact toward engagement with the other of said contacts, (b) motive means for developing a circuit-breaker closing force for application to the movable contact rods of all of said interrupters, (c) a common operating member through which said closing force is applied to the movable contact rods of all of said interrupters, said common operating member being the closest common operating member to said interrupters in the drive train to the interrupters if there is more than one common operating member, (d) a wipe mechanism for each of said interrupters comprising a wipe spring through which closing force is applied to the contact rod of the associated interrupter and a force-transmitting member for transmitting closing force to said wipe spring, (e) a plurality of linkages, one for each interrupter, each linkage being connected between said common operating member and said force-transmitting member in the wipe mechanism for the associated interrupter, (f) each of said linkages comprising a plurality of pin joints connected mechanically in series between said common operating member and said associated force-transmitting member, each of said pin joints comprising a pin and a bearing that rotates with respect to said pin during circuit-breaker closing, a preselected one of said pin joints in each linkage being located at the contact-end of the associated linkage for coupling said contact-rod end of the linkage to the associated force-transmitting member, said preselected pin joint being devoid of any lost motion usable to effect significant changes in stroke length of the associated interrupter, and (g) opening spring means effectively located at the movable contact-rod end of each of said linkages that comprises at least three of said series-connected pin joints for applying a bias to said associated three-or-more pin joint linkage that acts upon all of the pin joints in said associated linkage to eliminate from said acted-upon pin joints such clearance as allows reversal of the associated movable contact rod immediately following contact-engagement near the end of a closing operation while closing force is still being applied to said associated linkage by said motive means.

2. The circuit breaker of claim 1 in which in said preselected pin joint the normal clearance between said pin and its associated bearing is less than 25 mils.

3. The circuit breaker of claim 1 in which the normal clearance between each pin and its associated bearing is less than 25 mils.

4. The vacuum-type circuit breaker of claim 1 in which said opening spring means comprises:

(a) a floating beam connected between two pin joints of two of said three-or-more pin joint linkages, said floating beam being movable with one of the components of each of the two pin joints between which it is connected, and (b) spring means acting on said floating beam for applying said bias to said two linkages.

5. The vacuum type circuit breaker of claim 1 in which said opening spring means comprises a separate opening spring for each of said three-or-more pin joint linkages, each said separate opening spring being effectively located at the contact-rod end of its associated linkage.

6. The vacuum type circuit breaker of claim 1 in which:

(a) each of said wipe mechanisms associated with a three-or-more pin joint linkage further comprises a bounce-suppressing spring acting in opposition to said wipe spring and discharging to aid continuing motion of said force-transmitting member in a closing direction during the initial stages of said continuing motion following initial contact-engagement, (b) said bounce-suppressing spring having a stiffness gradient sufficiently low to effectively prevent separation of said contacts immediately following said initial contact-engagement at the end of a closing stroke, and (c) said associated three-or-more pin joint linkage has a stiffness gradient that would permit said contact separation immediately following said initial contact-engagement if said bounce-suppressing spring was absent from its associated wipe mechanism.

7. The vacuum-type circuit breaker of claim 1 in which said motive means imposes insufficient positive acceleration on said linkage during closing to eliminate the clearances of (g), claim 1, assuming a three-or-more pin joint linkage in which the opening spring means is located on the motive-means side of three pin joints in the linkage instead of at the contact-rod end of the linkage.

* * * * *